US005387922A

United States Patent [19]

Yun

[11] Patent Number: 5,387,922

[45] Date of Patent: Feb. 7, 1995

[54] APPARATUS FOR DRIVING AN LCD MODULE WITH ONE DRIVING CIRCUIT

[75] Inventor: Sai C. Yun, Kyungsangbook-Do, Rep. of Korea

[73] Assignee: Goldstar Co., Ltd., Seoul, Rep. of Korea

[21] Appl. No.: 133,737

[22] Filed: Oct. 8, 1993

Related U.S. Application Data

[63] Continuation of Ser. No. 813,964, Dec. 24, 1991, abandoned.

[30] Foreign Application Priority Data

Dec. 28, 1990 [KR] Rep. of Korea ..... 22168/1990

[51] Int. Cl.[6] ..... G09G 3/20

[52] U.S. Cl. ..... 345/103; 345/100

[58] Field of Search ..... 345/100, 103, 101; 359/57

[56] References Cited

U.S. PATENT DOCUMENTS

| | | | |
|---|---|---|---|
| 4,346,378 | 8/1982 | Shanks | 340/784 |
| 4,730,140 | 3/1988 | Masubuchi | 340/784 |
| 4,779,085 | 10/1988 | Mizutome et al. | 340/805 |
| 5,049,865 | 9/1991 | Nakamura et al. | 340/784 |

FOREIGN PATENT DOCUMENTS

| | | | |
|---|---|---|---|
| 2106690 | 4/1983 | United Kingdom . | |
| 2165984 | 4/1986 | United Kingdom | 340/784 |

*Primary Examiner*—Ulysses Weldon
*Assistant Examiner*—Amare Mengistu
*Attorney, Agent, or Firm*—Ostrolenk, Faber, Gerb & Soffen

[57] ABSTRACT

Apparatus for driving a liquid crystal display module provided with one driving circuit for outputting overflown LCD driving circuit. The LCD driving controller outputs two groups of scanning signals which are sequentially outputted at two timings being different from each other, synchronously with LCD driving data for each and every dot. The driving circuit receives overflown LCD driving data which has overflowed the capacity of the LCD driving controller. The LCD panel has scanning electrodes which are divided into two groups, that is, a first group of scanning electrodes corresponding to the first to eightieth dots and a second group of scanning electrodes corresponding to the eighty first to hundredth dots, and has signal electrodes which are applied with the LCD driving data outputted from the LCD driving controller and the driving circuit, respectively, in order to display the characters on the character display member thereof. The driving apparatus of this invention provides advantage in that it needs only one driving circuit for outputting overflown LCD driving data, thereby simplifying the construction thereof and reducing the manufacturing cost and also improving the productivity due to the simplification of the construction thereof.

2 Claims, 3 Drawing Sheets

APPARATUS FOR DRIVING AN LCD MODULE WITH ONE DRIVING CIRCUIT

This is a continuation of application Ser. No. 07/813,964 filed on Dec. 24, 1991 now abandoned.

BACKGROUND OF THE INVENTION

1. Field of the Invention

The present invention relates in general to a liquid crystal display LCD module driving apparatus, and more particularly to an LCD module driving apparatus with one driving circuit in which LCD driving data output ports of an LCD driving controller are used for outputting LCD driving data at a timing for driving a group of scanning electrodes and also a part of the LCD driving data output ports are used once more for outputting the LCD driving data at another timing for driving another group of scanning electrodes of the LCD panel, thereby causing only one driving circuit to be equipped, thus simplifying the construction thereof.

2. Description of The Prior Art

With reference to FIG. 1, known LCD panels, each having twenty character display parts sequentially arranged in a line, generally have a plurality of pixel electrodes and a common electrode which are disposed between an upper substrate 11 and a lower substrate 12. Here, each pixel electrode corresponds to each and every dot and is provided with a color filter. In manufacturing such an LCD panel, the upper and lower substrates 11 and 12 receive therebetween a liquid crystal which is injected between the pixel electrodes and the common electrode, then are hermetically sealed, thereby providing a character display member 11*a* disposed on the upper panel 11. Here, the upper and lower substrates 11 and 12 are generally made of glass, while the pixel electrodes and the common electrode are generally formed as coating a transparent conductive coat such as an ITO (Indium Tin Oxide) coat.

As shown in FIG. 2, the character display member 11*a* of the conventional LCD module is comprised such that one character display consists of 5×7 dots, one character display cursor consists of 5×1 dots. Therefore one character display part consists of 5×8 dots, resulting from adding the one character display of 5×7 dots to the one character display cursor of 5×1 dots. Thus upon sequentially arranging twenty character display parts, each consisting of 5×8 dots, in a line, the character display member 11*a* results.

On the other hand, the known LCD panel is provided with a scanning electrode pattern of C1 to C8 which are applied with scanning signals, furthermore, provided with a signal electrode pattern of S1 to S100 which are applied with character display data, as shown in FIG. 3. Thus, upon being applied with the scanning signals and the character display signals, each pixel electrode for each dot disposed at a cross position of each signal electrode and each scanning electrode may be driven by means of a thin film transistor.

As shown in FIG. 4, the known apparatus for driving such a LCD module having the character di splay member 11*a* consisting of twenty character display parts sequentially arranged in a line, hereinafter said type of LCD module being referred to simply as "the LCD module", includes a LCD driving controller 20 which outputs scanning signals from scanning signal output ports Q1 to Q8 to the scanning electrodes C1 to C8 of the LCD panel 10 synchronously with generation of LCD driving data corresponding to the one hundred dots which corresponds to the twenty character display parts. At this time, the LCD driving controller 20 directly outputs a part of the LCD driving data from the driving data output ports D1 to D40 thereof to the signal electrodes S1 to S40 of the LCD panel 10, but indirectly outputs the other LCD driving data, which overflows the driving data output ports D1 to D40 thereof, to the signal electrodes S41 to S100 by way of a pair of driving circuits, that is, a first circuit 30 and a second circuit 40.

Here, the first driving circuit 30 receives the other LCD driving data, which overflowed the driving data output ports D1 to D40 thus applied from the ports D1 to D40 thereto, then outputs a part of the received LCD driving data from output ports Y1 to Y40 thereof to the signal electrodes S41 to S80 of the LCD panel 10, while the second driving circuit 40 receives the LCD driving data, which overflowed the output ports Y1 to Y40 of the first circuit 30 thus applied from the ports Y1 to Y40 thereto, then outputs the received LCD driving data to the signal electrodes S81 to S100 of the LCD panel 10.

The operation of the known apparatus for driving the LCD module having the above construction will be described hereinafter.

Upon receiving character display data and a control signal outputted from a central processing unit (CPU, not shown) of an external system, the LCD driving controller 20 generates LCD driving data for driving the LCD panel 10 by means of a ROM, which is adapted for generating the character, synchronously with generation of the scanning signals. The scanning signals are sequentially outputted from the scanning output ports Q1 to Q8 to the scanning electrodes C1 to C8 of the LCD panel 10, while the LCD driving data is outputted from the driving data output ports D1 to D40 of the controller 20.

At this time, the first to fortieth signal electrodes S1 to S40 of the LCD panel 10 are directly applied with the LCD driving data directly outputted from the driving data output ports D1 to D40 of the controller 20. However, if the LCD driving data overflows the driving data output ports D1 to D40 of the controller 20, the overflown LCD driving data is outputted from the driving data output ports D1 to D40 in order to be received in the first driving circuit 30, then outputted from the driving data output ports Y1 to Y40 of the first driving circuit 30 to the forty first to eightieth signal electrodes S41 to S80 of the LCD panel 10. In addition, if the LCD driving data also overflows the output ports Y1 to Y40 of the first driving circuit 30, the overflown data is outputted from the first circuit 30 in order to be received in the second driving circuit 40, then outputted from the output ports Y1 to Y20 of the second circuit 40 to the signal electrodes S81 to S100 of the LCD panel 10.

Here, the second circuit 40 generally has forty driving data output ports but uses only twenty output ports in outputting the overflown LCD driving data.

The scanning electrodes of the LCD panel 10 comprise, as described above, eight electrode lines of C1 to C8, thus, the one hundred signal electrodes S1 to S100 of the LCD panel 10 are applied with the LCD driving data at $\frac{1}{8}$ duty cycle in one screen driving period of the LCD module in order to drive the LCD pane 10.

In brief, the one hundred signal electrodes S1 to S100 of the LCD panel 10 are applied with the LCD driving data in order to drive the character display member 11*a* under such manner that the first to fortieth signal electrodes S1 to S40 are directly applied with the data directly outputted from the output ports D1 to D40 of the controller 20, and the forty first to eightieth signal electrodes S41 to S80 are applied with the LCD driving data outputted from the first driving circuit 30, additionally, the eighty first to hundredth signal electrodes S81 to S100 are applied with the LCD driving data outputted from the second driving circuit 40. Thus, the known apparatus for driving the LCD module has disadvantage in that it additionally includes the second driving circuit 40 which, despite of being provided with forty output ports due to the conventional chip construction, uses only twenty output ports of the forty output ports in outputting the LCD driving data, thereby deteriorating the using efficiency of the second circuit 40. Furthermore, the known apparatus comprises two driving circuits 30 and 40 for outputting the LCD driving data, thereby causing the construction and the manufacturing process of the apparatus to be complex, thus deteriorating the productivity.

SUMMARY OF THE INVENTION

It is, therefore, an object of this invention to provide LCD module driving apparatus with one driving circuit in which the above disadvantage can be overcome, and LCD driving data output ports of a LCD driving controller are used for outputting LCD driving data at a timing for driving a group of scanning electrodes and also a part of the LCD driving data output ports are used once more for outputting the LCD driving data at another timing for driving another group of scanning electrodes of the LCD panel, thereby causing only one driving circuit to be equipped, thus simplifying the construction thereof.

The above-mentioned object of this invention can be accomplished by providing LCD module driving apparatus with one driving circuit comprising: a LCD driving controller which upon receiving character display data and a control signal from an external central processing unit, outputs two groups of scanning signals, each said group of scanning signals corresponding to first to eightieth dots or eighty first to hundredth dots and being sequentially outputted at each timing, and outputs LCD driving data corresponding to the first to fortieth dots at forty LCD driving data output ports thereof synchronously with one group of scanning signals outputted at a first timing, outputs overflown LCD driving data which overflows the capacity of said controller and corresponds to the forty first to eightieth dots at said LCD driving data output ports at said first timing, and also outputs LCD driving data corresponding to the eighty first to hundredth dots at a part of said LCD driving data output ports synchronously with the other group of scanning signals outputted at a second timing; a driving circuit which receives said overflown LCD driving data which overflowed the forty LCD driving data output ports of the LCD driving controller, then outputs said overflown LCD driving data as LCD driving data, which data corresponds to the forty first to eightieth dots, at forty output ports thereof; and a LCD panel in which the scanning electrodes thereof are divided into two groups, that is, a first group of scanning electrodes corresponding to the first to eightieth dots and a second group of scanning electrodes corresponding to the eighty first to hundredth dots, thus said scanning electrodes in each group are applied with said scanning signals in each group outputted at said scanning signal output ports of the LCD driving controller at each timing, thereby being driven by being applied with said LCD driving data through signal electrodes thereof.

BRIEF DESCRIPTION OF THE DRAWINGS

Other object and aspects of the invention will become apparent from the following description of embodiments with reference to the accompanying drawings in which.

DETAILED DESCRIPTION OF THE PREFERRED EMBODIMENTS

Figure 1:
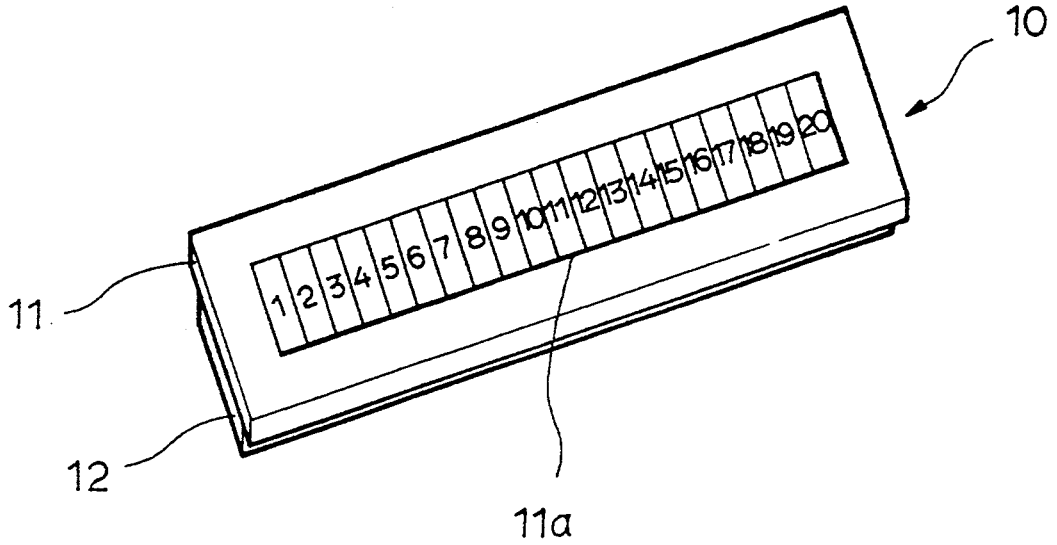
FIG.1 PRIOR ART
FIG. 1 is a schematic perspective view showing a LCD panel according to the prior art.
Figure 2:
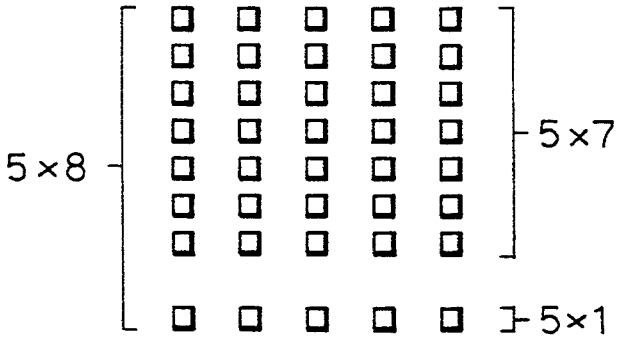
FIG.2 PRIOR ART
FIG. 2 shows a dot construction of one character display part of the known LCD panel of FIG. 1.
Figure 3:
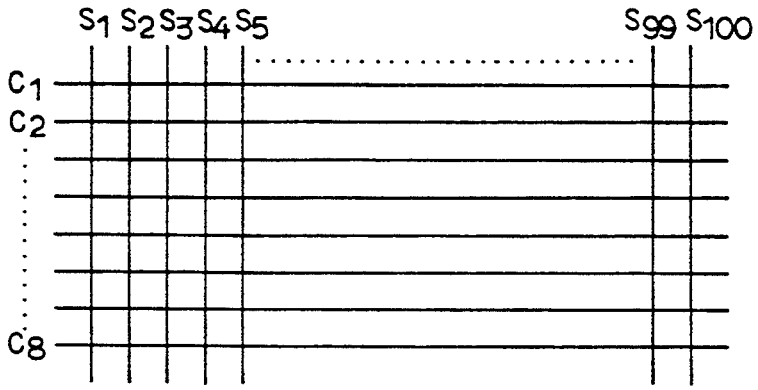
FIG. 3 PRIOR ART
FIG. 3 is a view showing a pattern of scanning and signal electrodes of the known LCD panel of FIG. 1.
Figure 4:
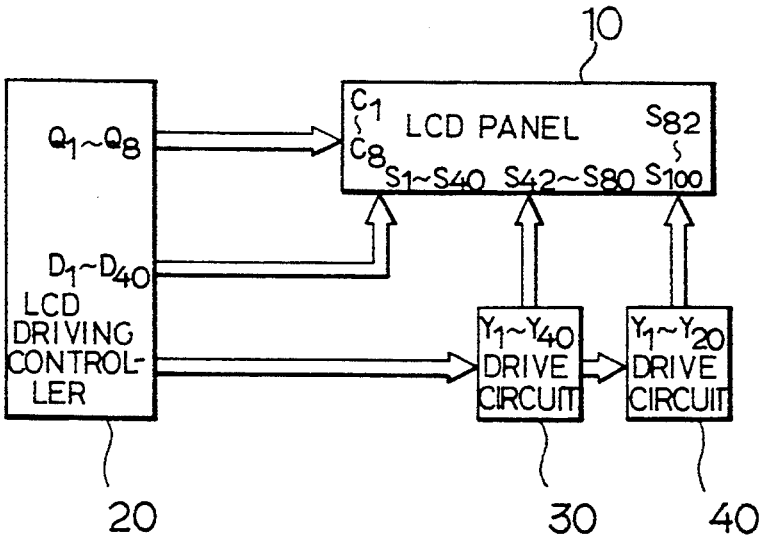
FIG. 4 PRIOR ART
FIG. 4 is a schematic view showing a construction of known LCD module driving apparatus.
Figure 5:
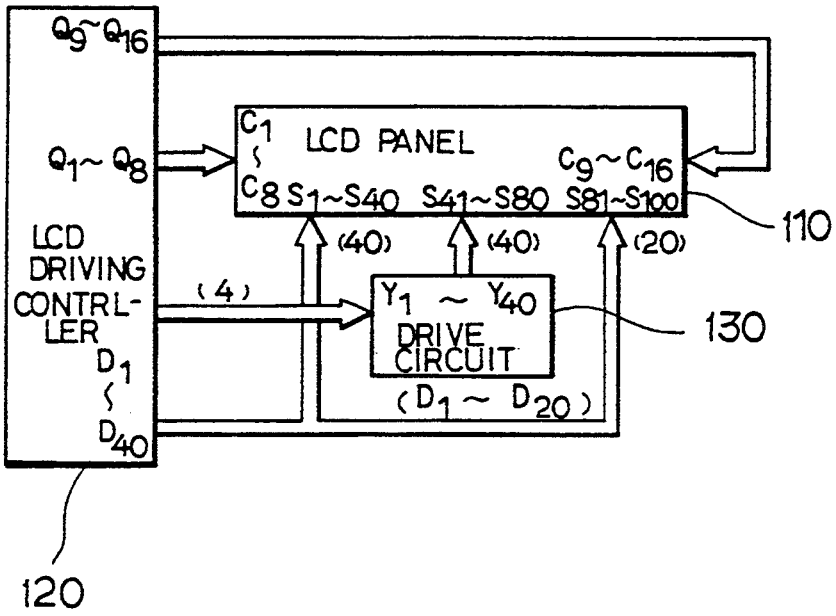
FIG. 5 is a view corresponding to FIG. 4, but showing the present invention.

Referring first to FIG. 5 showing a schematic view showing a construction of LCD module driving apparatus according to this invention, the apparatus includes a LCD driving controller 120 which upon receiving character display data and a control signal from an external central processing unit (CPU, not shown), outputs two groups of scanning signals, said groups of scanning signals being sequentially at two timings which are different from each other, synchronously with LCD driving data for each and every dot. A driving circuit 130 is additionally provided for receiving overflown LCD driving data which has overflowed LCD driving data output ports D1 to D40 of the LCD driving controller 120. Thus, overflown LCD driving data is outputted from the driving circuit 130.

In addition, the apparatus of this invention includes a LCD panel 110 in which scanning electrodes are divided into two groups, that is, a first group of scanning electrodes C1 to C8 corresponding to the first to eightieth dots and a second group of scanning electrodes C9 to C16 corresponding to the eighty first to hundredth dots. Thus, scanning electrodes in each group are applied with scanning signals outputted from the LCD driving controller 120. In addition, the signal electrodes S1 to S100 are applied with the LCD driving data outputted from the LCD driving controller 120 and the driving circuit 130, respectively, in order to display the characters on the character display member of the LCD panel 110.

Here, the LCD driving controller 120 includes two groups of scanning signal output ports Q1 to Q8 and Q9 to Q16 and also the LCD driving data output ports D1 to D40. The controller 120 sequentially outputs the scanning signals at scanning signal output ports Q1 to Q8 or Q9 to Q16 in each group at each timing, upon receiving the display data and the control signal from the external CPU. At this time, the controller 120 generates LCD driving data corresponding to each and every dot of the LCD panel 110 by virtue of a ROM which is adapted for generating the LCD driving data, then outputs the LCD driving data at the LCD driving data output ports D1 to D40 thereof synchronously with each group of the scanning signals sequentially outputted at each timing of scanning signal at each group of scanning signal output ports Q1 to Q8 or Q9 to Q16. Thus, the forty output ports D1 to D40 of the controller 120 are used for outputting the LCD driving data corresponding to the first to forty dots at a timing and used once more for outputting the LCD driving data corresponding to the forty first to eightieth dots at another timing.

Figure 6:
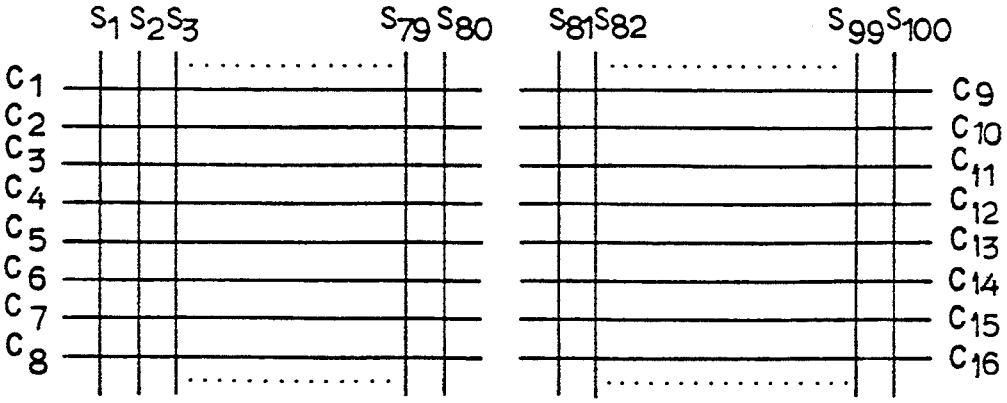
FIG. 6 is a view corresponding to FIG. 3, but showing the present invention.

With reference to FIG. 6, the LCD panel 110 has first to eighth scanning electrodes C1 to C8 which correspond to the first to eightieth dots and receive the scanning signals outputted from the first group of scanning signal output ports Q1 to Q8 of the controller 120, and ninth to sixteenth scanning electrodes Q9 to Q16 which correspond to the eighty first to hundredth dots and receive the scanning signals outputted from the second group of scanning signal output ports Q9 to Q16 of the controller 120. The panel 110 additionally has first and second groups of signal electrodes, that is, first to fortieth signal electrodes S1 to S40 and eighty first to hundredth signal electrodes S81 to S100, in which groups the signal electrodes in first group are applied with the LCD driving data directly outputted from the LCD driving data output ports D1 to D40 of the controller 120 at a timing, while the signal electrodes in second group are applied with the LCD driving data directly outputted from the LCD driving data output ports D1 to D20 of the controller 120 at another timing. Also, there are provided in the LCD panel 120 a third group of signal electrodes, that is, forty first to eightieth signal electrodes S41 to S80 which are applied with the LCD driving data outputted from the driving circuit 30. In result, the LCD panel 120 displays desired characters on the character display parts thereof in accordance with the LCD driving data.

The operational effect of the LCD module driving apparatus of this invention will be described hereinafter.

Upon receiving character display data and a control signal outputted from an external CPU, the LCD driving controller 120 addresses a ROM (not shown) for generating LCD driving data in accordance with the character display data, then outputs addressed data, which has been generated by the ROM as the LCD driving data, simultaneously with outputting the scanning signals of a predetermined frequency. On the other hand, the controller 120 sequentially outputs the scanning signals from the first to sixteenth scanning electrodes C1 to C16 thereof at the same time. At this time, the controller 120 additionally generates the LCD driving data corresponding to the first to eightieth dots and outputs said LCD driving data at a timing for driving the first to eighth scanning electrodes C1 to C8 of the LCD panel 120, while it generates the LCD driving data corresponding to the eighty first to hundredth dots and outputs said LCD driving data at another timing for driving the ninth to sixteenth scanning electrodes C9 to C16 of the LCD panel 120.

In accordance, the first to fortieth signal electrodes S1 to S40 of the LCD panel 110 are directly applied with the LCD driving data directly outputted from the driving data output ports D1 to D40 of the controller 120. In addition, the forty first to eightieth signal electrodes S41 to S80 of the LCD panel 110 are applied with the overflowed LCD driving data, which data overflowed the driving data output ports D1 to D40 of the controller 120, and was received in the first driving circuit 130, then outputted from the driving data output ports Y1 to Y40 of the first driving circuit 130.

Thereafter, the controller 120 sequentially outputs the scanning signals at the ninth to sixteenth scanning electrodes C9 to C16 in order to drive them, and also outputs the LCD driving data from the first to twentieth output ports D1 to D20 thereof to the eighty first to hundredth signal electrodes S81 to S100 of the LCD panel 110.

Thus, the LCD module driving apparatus of this invention displays the desired characters in a cycle corresponding to the sixteen scanning electrodes of the LCD panel 110 because the scanning electrodes are divided into two groups as described above, so that it drives one scanning line of the LCD panel 110 at 1/16 duty cycle.

As described above, the present invention provides LCD module driving apparatus in which the scanning electrodes of the LCD panel are divided into two groups, and the LCD driving data output ports of the LCD driving controller are used for outputting the LCD driving data at a timing for driving a group of scanning electrodes and also a part of the LCD driving data output ports are used once more for outputting the LCD driving data at another timing for driving another group of scanning electrodes of the LCD panel 120. Thus, the driving apparatus of this invention provides advantage in that it needs only one driving circuit for outputting overflown LCD driving data, thereby simplifying the construction thereof and reducing the manufacturing cost and also improving the productivity due to the simplification of the assembling process of the apparatus.

Although the preferred embodiments of the invention have been disclosed for illustrative purpose, those skilled in the art will appreciated that various modifications, additions and substitutions are possible, without departing from the scope and spirit of the invention as disclosed in the accompanying claims.

What is claimed is:

1. Apparatus for driving a liquid crystal display module comprising:

control means for outputting display data synchronously with scanning signals which are outputted therefrom at timings associated with said scanning signals, said timings being different from each other, said display data being outputted upon being received by said control means and upon receipt of a control signal by said control means;

driving means for outputting overflowed display data from Said control means which has overflowed a data capacity of said control means; and display means for displaying data thereon, upon receiving scanning signals outputted from the control means in accordance with said timings of the scanning signals, said display means receiving said display data outputted from said control means, and said overflowed display data from said driving means;

said control means including two groups of scanning signal output ports at which said scanning signals are outputted at each different timing, and also including a plurality of display data output ports for outputting said display data such that the display data are outputted at said display data output ports at one timing of said scanning signals and also once more outputted at a part of said display data output ports at another timing of said scanning signals;

said driving means including a single driving circuit for receiving said overflowed display data and being effective for outputting the overflowed display data to said display means;

said display means including a liquid crystal display panel having two groups of scanning electrodes corresponding to said two groups of scanning signal output ports of the control means, said one group of scanning electrodes receiving scanning signals from said one group of scanning signal output ports of the control means and covering a first plurality of dots, said another group of scanning electrodes receiving scanning signals from said another group of scanning signal output ports of the control means and covering a second plurality of dots, and also having signal electrodes divided into two groups corresponding to said display data output ports of the control means, each of said signal electrodes receiving display data from said display data output ports.

2. The apparatus for driving a liquid crystal display module of claim 1, wherein said first group of dots comprises first to eightieth dots and wherein said second group of dots comprises eighty-first to one hundredth dots.

* * * * *